United States Patent [19]

Filipchuk

[11] Patent Number: 5,074,098

[45] Date of Patent: Dec. 24, 1991

[54] METHOD OF STORING A WET PAINT ROLLER SLEEVE

[76] Inventor: Donald Filipchuk, 270 Brooklyn St., Winnipeg, Manitoba, Canada, R3J 1M2

[21] Appl. No.: 563,083

[22] Filed: Aug. 6, 1990

[51] Int. Cl.[5] ..... B65B 7/28

[52] U.S. Cl. ..... 53/397; 53/471; 53/485; 53/594; 206/209; 206/229

[58] Field of Search ..... 15/104.94, 257.06; 206/15.3, 209, 229, 361; 53/397, 410, 413, 580, 594, 128.1, 420, 471, 485

[56] References Cited

U.S. PATENT DOCUMENTS

| | | | |
|---|---|---|---|
| 1,709,860 | 4/1929 | Lovett | 53/594 X |
| 3,398,825 | 8/1968 | Flook et al. | 206/209 |
| 3,918,582 | 11/1975 | Wallace | 206/209 X |
| 3,955,670 | 5/1976 | Buslik | 206/209 X |
| 4,200,949 | 5/1980 | Heniff | 15/257.06 |
| 4,299,005 | 11/1981 | Brown | 15/104.94 X |
| 4,738,358 | 4/1988 | Kehl | 206/361 X |
| 4,802,576 | 2/1989 | Kern | 206/361 X |

*Primary Examiner*—John Sipos
*Assistant Examiner*—Linda B. Johnson
*Attorney, Agent, or Firm*—Adrian D. Battison; Stanley G. Ade; Murray E. Thrift

[57] ABSTRACT

A container for storing a wet paint roller comprises a cylindrical sleeve with two end caps closing the sleeve to form a cylindrical container. The sleeve at one end has a short slot extending axially of the sleeve and a cooperating slot is provided in the end cap to align with the slot on the sleeve. In the method of use, the wet paint roller including the textile surface and the handle are both inserted into the container with the portion of the handle which extends from the axial rod passing through the slot in the sleeve and the slot in the end cap thus containing the whole of the paint covered part within the container and leaving the handle exposed outside the container.

2 Claims, 1 Drawing Sheet

METHOD OF STORING A WET PAINT ROLLER SLEEVE

BACKGROUND OF THE INVENTION

This invention relates to a container for storing a paint roller sleeve particularly when the sleeve is covered with paint material in an unset condition.

The cleaning of paint roller sleeves after a painting process is a highly undesirable and time consuming process and is often ignored by the user leading to the destruction of the paint roller sleeve as the paint material, sets. In many cases the same paint roller sleeve is intended to be used for the same paint material after a waiting period for example while a first coat of the paint material sets or overnight after work is finished or even during a lunch break. In most cases it is necessary to clean the sleeve during these delay periods since otherwise the paint material will set on the sleeve leading to its degradation or complete desctruction.

Up till now no equipment is known which allows the paint roller and sleeve to be simply stored and the user is faced with the necessity for cleaning the paint roller sleeve at all of these delay periods.

SUMMARY OF THE INVENTION

It is one object of the present invention, therefore, to provide a method and apparatus for storing a paint roller and sleeve of this type which avoids the necessity for cleaning of the roller and sleeve for short term periods or even for longer term periods at the discretion of the user.

According to the invention, therefore, there is provided a method of storing a paint roller sleeve comprising inserting a cylindrical roller sleeve having a textile peripheral surface and an unset paint material in the textile surface into a cylindrical container having a sleeve shaped wall dimensioned to receive the sleeve with the surface substantially wholly in contact with an inner surface of the wall, applying an end closure to at least one end of the wall such that the container is substantially fully closed and containing the sleeve within the container such that the paint material remains unset.

According to a second aspect of the invention, therefore, there is provided a paint roller and storing apparatus therefore comprising a cylindrical roller sleeve having a textile peripheral surface, the container comprising an elongate sleeve member having a cylindrical wall dimensioned to receive the sleeve with the textile surface thereof substantially in contact with an inner surface of the cylindrical wall and end closure means for closing the ends of the cylindrical wall at least one of the enclosure means being removable for insertion of the sleeve into the container.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
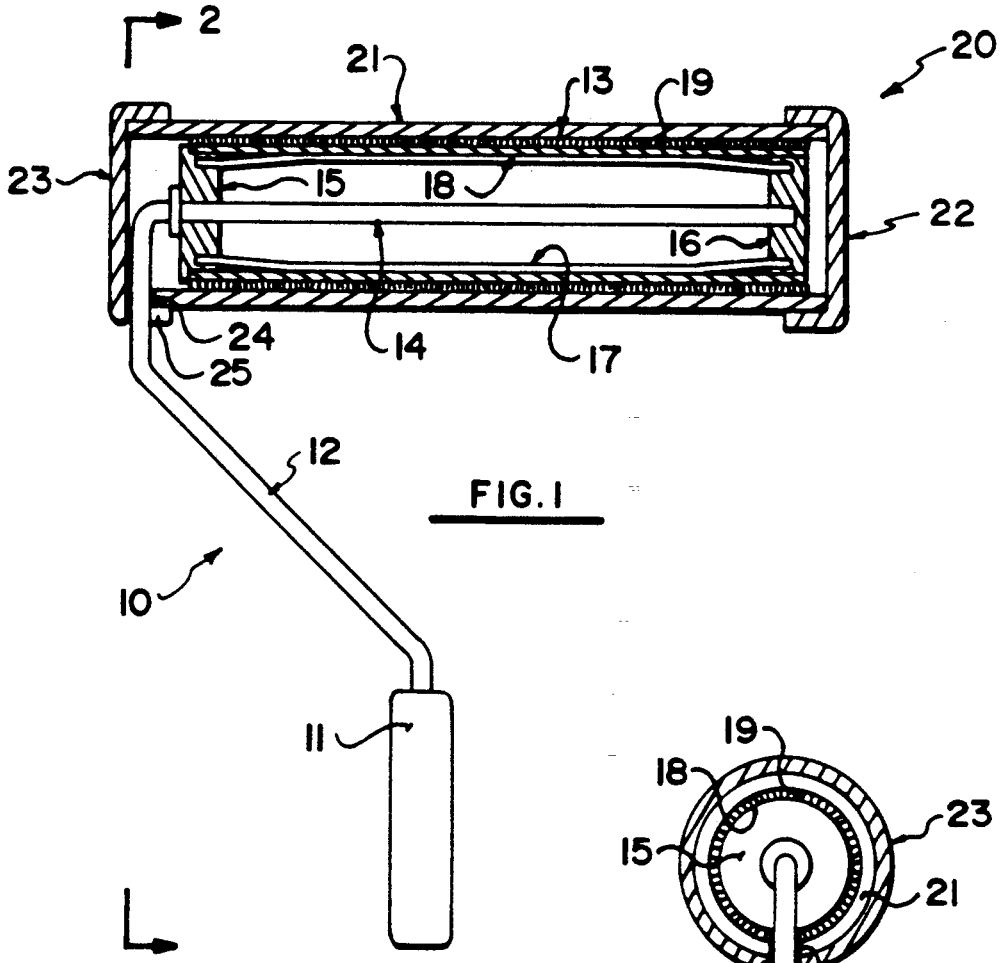
FIG. 1 is a cross sectional view through a paint roller, sleeve and container apparatus therefor.

A conventional paint roller is indicated generally at 10 and includes a handle having a hand grip portion 11 and support rod 12 extending from the hand grip portion to one end of the roller portion 13. The rod 12 curves around so that it enters the roller portion 13 at one end and defines an elongate shaft portion 14 on which the roller portion turns.

The handle further includes a pair of discs 15 and 6 mounted on the shaft 14 and gripping elements 17 extending between the outer periphery of the discs generally parallel to the shaft 14 for grasping the inside surface of the removable roller sleeve.

The roller sleeve includes a substantially rigid support section 18 and a textile surface 19 mounted on the outer surface of the rigid support. The textile surface can pick up paint from a suitable supply for application to a surface by rolling of the textile material across the surface. This construction is of course conventional and in many cases the cylindrical rigid support sleeve 18 and the attached textile material 19 are readily removable from the handle portion for replacement when worn or damaged.

The present invention provides a container generally indicated at 20 including a rigid cylindrical wall portion 21 and a pair of end caps 22 and 23. The rigid cylindrical wall 21 has an inner surface which is dimensioned to receive the textile material as a substantially sliding fit so that there is little or no air space between the inside surface of the wall 21 and the textile material thus preventing air from accessing the paint material when the roller is received within the container with paint material remaining on the textile material. The length of the cylindrical wall is arranged so that it is slightly greater than the length of a conventional roller. Thus it can receive the full length of the roller together with a short length of extra wall length at the left hand end as shown.

The end caps 22 and 23 can be of a simple type which slide on over the outside surface of the wall 21 to grip against the outside surface as a friction fit.

In some cases the container is designed simply to receive the outside roller sleeve portion including the support 18 and the textile material 19 when the handle has been removed.

Figure 2:
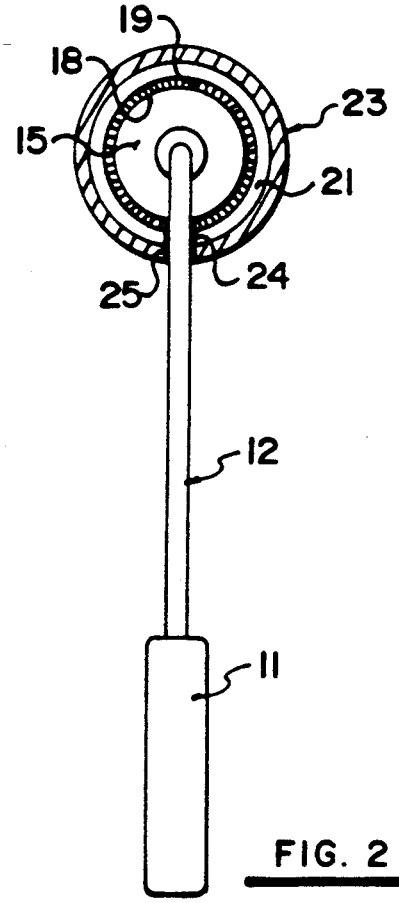
FIG. 2 is a cross sectional view along the lines 2—2 of FIG. 1.

In other cases as shown in FIGS. 1 and 2, the handle can remain in place when the roller and sleeve are stored within the container. In this case a slot 24 is provided in the cylindrical wall extending axially of the cylindrical wall from one end thereof. The slot cooperates with a similar slot 25 provided in the periphal wall portion of the end cap 23 so that both slots overlap to leave a small confined opening through which the rod portion of the handle can pass at its normal position at the end of the roller at which it extends radially from the rod portion 14 toward the hand grip 11.

A paint filled roller and sleeve can thus be inserted into the storage container after use and with the paint material remaining in place and can remain within the container for several weeks without the paint material setting and destroying the textile material of the roller sleeve. In addition when the paint roller and sleeve are removed from the container the roller is immediately ready for use with the same paint material without necessity for cleaning or for removal of cleaning fluids.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method for storing a paint roller, the paint roller comprising a roller sleeve having a textile peripheral surface surrounding a longitudinal axis of the sleeve, a core on which the sleeve is mounted and is supported thereby and a handle defined by a rod having a support portion extending along the axis of the sleeve on which the core is mounted such that the support rod projects outwardly from one end of the sleeve with an opposed end of the sleeve being supported in cantilever manner from said one end, a handle portion extending to one side of the sleeve generally at right angles to the axis and a connecting portion extending from the handle portion around said one end of the sleeve to connect to the support portion, the sleeve having an unset paint material in the textile surface, the method comprising inserting the paint roller into a cylindrical container having a sleeve shaped wall dimensioned to receive the sleeve with the textile surface substantially wholly in contact with an inner surface of the wall the sleeve being inserted into the container by sliding longitudinally along said axis with said opposed end entering first into the container to reach a far end of the container and said one end being received at a rear end of the container, defining an axially extending slot in the wall of the container at the rear end thereof, locating the connecting portion of the handle at the slot so as to pass through the slot from the support portion inside the container to the handle portion outside the container, applying a first separate readily removable end closure member to said far end of the container, applying a second separate readily removable end closure member to the rear end, said second end closure member also covering part of said slot such that the container is substantially fully closed and containing the sleeve within the container such that the paint material remains unset.

2. The method according to claim 1 including providing a cooperating slot in a peripheral wall portion of the second end closure member, said cooperating slot being aligned with said slot and receiving the connecting portion.

* * * * *